US006454224B1

(12) United States Patent
Nogueira

(10) Patent No.: US 6,454,224 B1
(45) Date of Patent: Sep. 24, 2002

(54) FOREARM AND WRIST SUPPORT ASSEMBLY FOR KEYBOARD USER

(76) Inventor: Dilip Nogueira, 16326 Barneston St., Granada Hills, CA (US) 91344

( * ) Notice: Subject to any disclaimer, the term of this patent is extended or adjusted under 35 U.S.C. 154(b) by 0 days.

(21) Appl. No.: 09/805,750

(22) Filed: Mar. 13, 2001

(51) Int. Cl.[7] ..... B43L 15/00

(52) U.S. Cl. ..... 248/118.5; 248/118; 248/918; 400/715

(58) Field of Search ..... 248/118.5, 118, 248/918, 297.11, 298.1, 278.1, 118.3, 291.1, 292.13, 292.14; 400/715; 340/711

(56) References Cited

U.S. PATENT DOCUMENTS

| | | | | | |
|---|---|---|---|---|---|
| 4,621,781 | A | | 11/1986 | Springer | 248/118 |
| 4,822,103 | A | | 4/1989 | Stenvall | 297/411.35 |
| 4,917,516 | A | | 4/1990 | Retter | 400/489 |
| 5,004,196 | A | * | 4/1991 | Gross | 248/118.3 |
| 5,056,743 | A | | 10/1991 | Zwar et al. | 248/118 |
| 5,143,422 | A | | 9/1992 | Althofer et al. | 297/411.36 |
| 5,161,760 | A | * | 11/1992 | Terbrack | 248/118 |
| 5,246,191 | A | | 9/1993 | Moss | 248/118.3 |
| 5,383,632 | A | * | 1/1995 | Shirlin | 248/118.5 |
| 5,398,896 | A | * | 3/1995 | Terbrack | 248/118.5 |
| 5,605,311 | A | * | 2/1997 | McGrath | 248/118 |
| 5,881,976 | A | * | 3/1999 | Gutowski | 248/118.5 |
| 6,042,064 | A | * | 3/2000 | Hong | 248/118.5 |

OTHER PUBLICATIONS

Advertisement for Ergo Rest Articulating Arm Support.

* cited by examiner

*Primary Examiner*—Ramon O. Ramirez
*Assistant Examiner*—Gwendolyn Baxter
(74) *Attorney, Agent, or Firm*—Freilich, Hornbaker & Rosen

(57) ABSTRACT

An assembly for supporting a user's forearm and wrists while still allowing substantially full mobility of the user's arms and hands to enable him to comfortably and effectively operate a keyboard and mouse. The assembly includes left and right subassemblies, each including an armrest. Each subassembly is configured to enable the armrest to (1) move laterally and longitudinally relative to a keyboard mounted on the surface of a support plate, (2) swivel about multiple axes oriented substantially perpendicular to the surface, and (3) tilt about an axis oriented substantially parallel to the surface.

17 Claims, 5 Drawing Sheets

20
22
26
34
36
42
44
46
48
50
52
54
56
57
58
60
63
64
66
68
80
82
84
90
410

28
44
40
100
102
105
104
106
107

BOTTOM VIEW

FOREARM AND WRIST SUPPORT ASSEMBLY FOR KEYBOARD USER

FIELD OF THE INVENTION

This invention relates to an assembly configured to support a keyboard user's forearms and wrists while allowing the user substantially full mobility of his forearms and hands for comfortably and effectively operating a keyboard and mouse. The assembly functions generally to reduce body fatigue and stress and more particularly to reduce the incidence of carpal tunnel syndrome and other occupational cumulative trauma disorders to the forearm and wrist.

BACKGROUND OF THE INVENTION

Various structures are described in the prior art for supporting the arms of a keyboard user to minimize body fatigue, e.g., shoulder, back, neck, wrist etc. The known devices are generally bulky and awkward to use and limit a user's ability to effectively manipulate a keyboard.

SUMMARY OF THE INVENTION

The present invention is directed to an assembly for supporting a user's forearms and wrists while still allowing substantially full mobility of the user's forearms and hands to enable him to comfortably and effectively operate a keyboard and mouse. More particularly, embodiments of the invention are specially configured to support a user's forearms and wrists while providing sufficient freedom of motion to permit the user to move his arms in an essentially natural manner as if they were not supported.

An assembly in accordance with the present invention includes left and right subassemblies, each including an armrest. Each subassembly is configured to enable the armrest to (1) move laterally and longitudinally relative to a keyboard mounted on the surface of a support plate, (2) swivel about multiple axes oriented substantially perpendicular to said surface, and (3) tilt about an axis oriented substantially parallel to said surface. "Lateral", as used herein, refers to side-to-side motion, i.e., substantially parallel to the key rows of a keyboard. "Longitudinal", as used herein, refers to motion essentially perpendicular to the key rows.

A preferred subassembly in accordance with the invention includes a post mounted for lateral motion along the surface of a keyboard support plate. The first end of a first link is coupled to the post for enabling the link to swivel around a first axis oriented substantially perpendicular to the support plate surface. A second link has a first end coupled to a second end of the first link for enabling the second link to swivel around a second axis oriented substantially perpendicular to said surface. The preferred subassembly further includes an armrest and means supporting the armrest on a second end of the second link for enabling the armrest to swivel around a third axis oriented substantially perpendicular to said surface and tilt around a fourth axis oriented substantially parallel to said surface.

In accordance with a preferred embodiment of the invention, the range of swivel movement around at least one of the aforementioned first, second, and third axes exceeds 360°. The range of tilting around said fourth axis is preferably limited to about ±20°.

A preferred armrest in accordance with the invention is contoured to comfortably support a user's forearm substantially horizontally, i.e. parallel to the aforementioned plate surface. The armrest preferably includes a central floor for supporting the user's forearm and spaced first and second upstanding side walls for cradling the forearm to enable the user to easily exert lateral and longitudinal forces for readily moving the armrest to a desired position. The upstanding sidewalls help maintain the user's wrist and forearm in alignment. The forward portion of the armrest floor preferably droops downwardly enabling the user to readily manipulate the keyboard without requiring any unusual wrist flexure. The inner surfaces of the armrest floor and side walls are preferably cushioned, e.g., by foam padding, to enhance user comfort.

Each subassembly post is preferably configured to telescope in order to set the armrest at a desired height above the support plate surface. The posts of the left and right subassemblies are preferably mounted along a guidepath adjacent to the plate surface for lateral movement to enable the user to move his forearms in a natural manner as if they were unsupported.

A support plate in accordance with the invention can comprise a desk or table top or a portable plate. Regardless, it typically defines a primary surface area for supporting an independent keyboard or laptop computer proximate to the left and right arm support subassemblies. Additionally, the support plate preferably includes a hinged plate portion defining a secondary surface area for supporting a pointing device, e.g., a mouse. The plate portion is preferably hinged so that the secondary surface area can be adjustably tilted relative to the primary surface area to facilitate user control of the pointing device.

DETAILED DESCRIPTION

Figure 1:
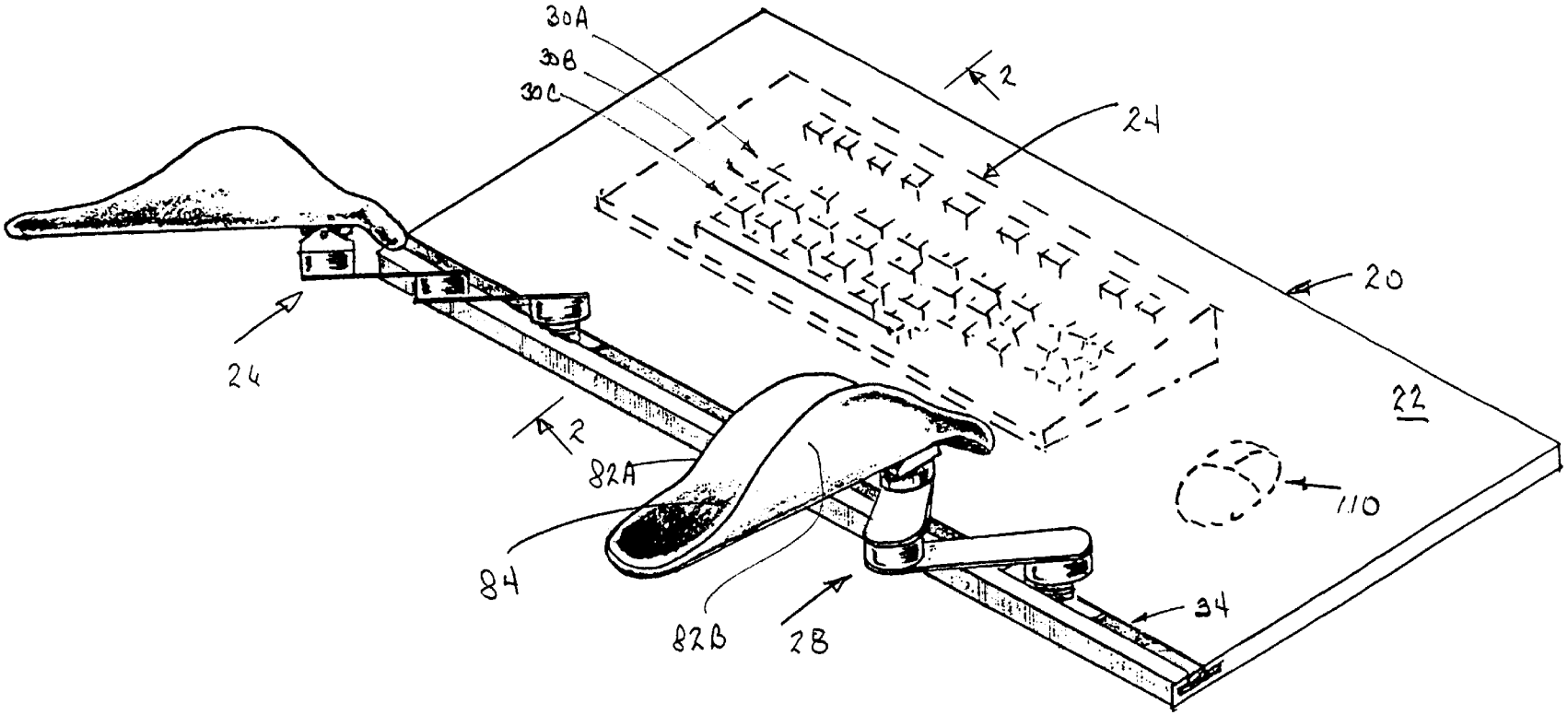
FIG. 1 is an isometric view of a forearm support assembly in accordance with the invention mounted on a keyboard support plate.

Attention is now directed to FIG. 1 which depicts a plate 20 defining an upper planar surface 22 for supporting a keyboard 24. An assembly in accordance with the present invention is comprised of a left arm support subassembly 26 and a right arm support subassembly 28 configured for mounting adjacent to the support plate 20 for supporting a user's forearms and wrists while allowing substantially full mobility of the user's arms and hands to enable the user to comfortably and effectively operate the keyboard. Use of an assembly in accordance with the invention considerably reduces body fatigue and stress and the risk of carpal tunnel syndrome and other occupational trauma injuries.

Although embodiments of the present invention can be utilized with a variety of keyboards, for purposes of clarity in explanation, it will be assumed that keyboard 24 comprises a standard computer keyboard having parallel rows of keys 30A, 30B, 30C, etc. The term "lateral" will be used herein to refer to side-to-side motion, i.e., substantially parallel to the key rows. The term "longitudinal" will be used herein to refer to motion essentially perpendicular to the key rows.

The left and right subassemblies 26 and 28 are configured to be mounted adjacent to the surface 22 of support plate 20 in spaced relationship as shown in FIG. 1. More particularly, each subassembly is independently mounted for translation along a laterally directed guideway 34. Inasmuch as the subassemblies 26 and 28 are constructed substantially identically, the following description should be interpreted as applying to either or both subassemblies unless the specific context indicates otherwise.

Figure 2:
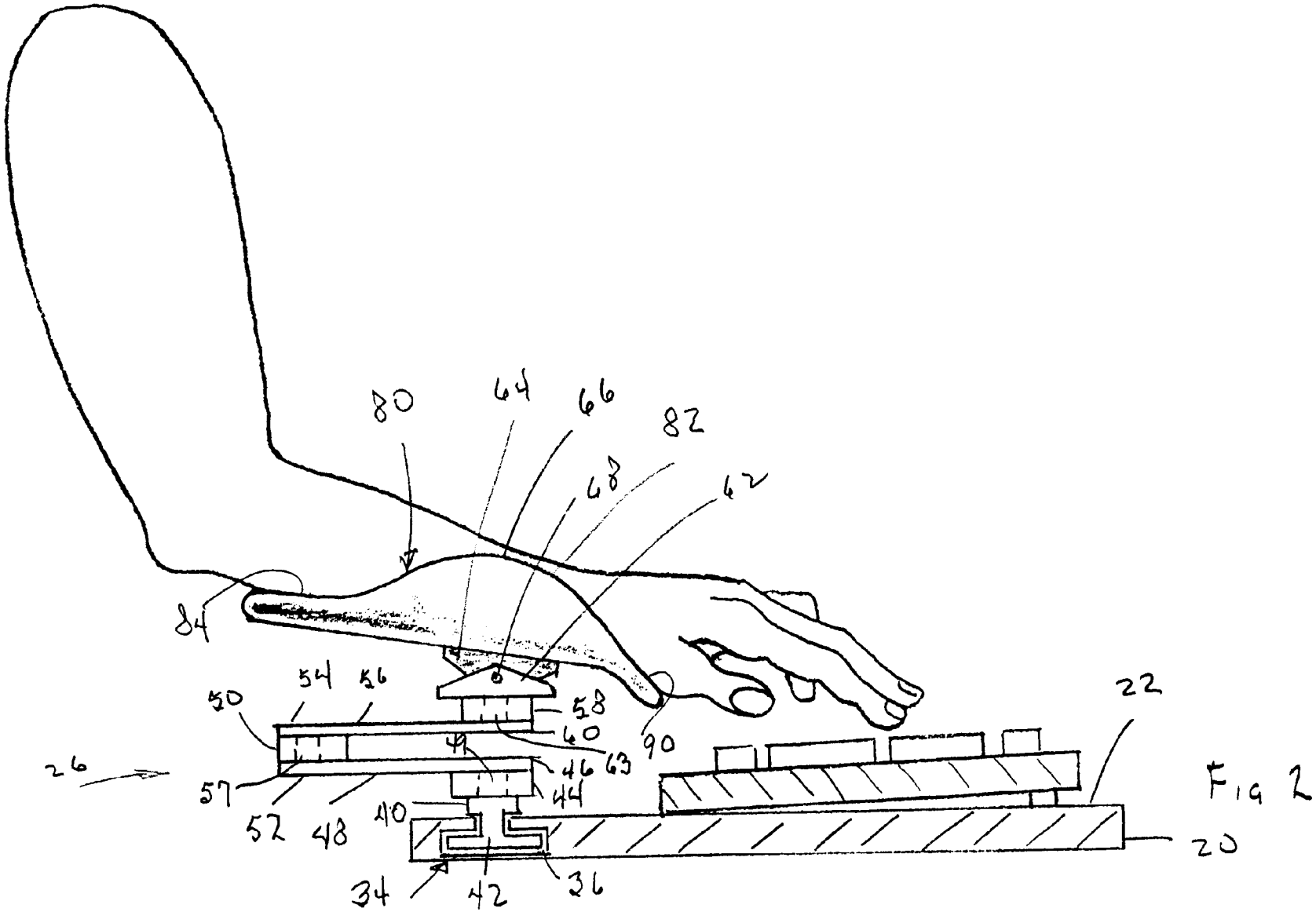
FIG. 2 is a sectional view taken substantially along the plane 2—2 of FIG. 1 showing a user's forearm supported in an armrest adjacent to a keyboard.

FIG. 2 comprises a sectional view taken substantially along the plane 2—2 of FIG. 1 and shows a user's forearm supported on the armrest of subassembly 26. The aforementioned guideway 34 is preferably defined by an inverted T-shaped channel 36 extending laterally across the support plate 20. A post 40 has a depending T-shaped member 42 receivable in the slot 36 for smooth translational movement along the guideway 34.

The post 40 carries a swivel coupling 44 at its upper end which couples to a first end 46 of a first rigid link 48. The coupling 44 enables the link 48 to swivel around a first axis 49 oriented substantially perpendicular to the support plate 20. A second swivel coupling 50 couples the second end 52 of first link 48 to the first end 54 of a second rigid link 56. The second coupling 50 enables the link 56 to swivel around a second axis 57 also oriented substantially perpendicular to the plate 20. A third swivel coupling 58 is supported between a second end 60 of second link 56 and a channel bracket 62. The third coupling 58 enables the channel bracket 62 to swivel around a third axis 63 also oriented substantially perpendicular to the support plate 20.

The channel bracket 62 is coupled to a base member 64 formed on the bottom side of an armrest 66. A pin 68 oriented substantially parallel to the surface 22 of support plate 20 couples bracket 62 to the armrest base 64 to enable the armrest to tilt around the pin axis 68. The couplings 44, 50, and 58, are preferably selected to enable unlimited swivel motion, i.e., greater than 360°. The tilt motion around horizontally oriented pin 68 is preferably limited, e.g., ±20°.

The armrest 66 is preferably formed of a contoured body 80 defining spaced side walls 82A, 82B and a central support floor 84. Note in FIG. 2 that the user's forearm is supported on the floor 84 between the spaced side walls 82A, 82B of the armrest body. Also note that the floor 84 droops down at 90 toward the front of the armrest body 80 to accommodate the user's wrist snd maintain the wrist substantially straight with respect to the user's forearm. Note that the tilt axis 68 is not centered under the armrest but is located closer to the front of the armrest under the user's wrist. Vertical movement of the user's hand to impact the keys is achieved primarily as a consequence of tilting the armrest around axis 68.

Figure 3:
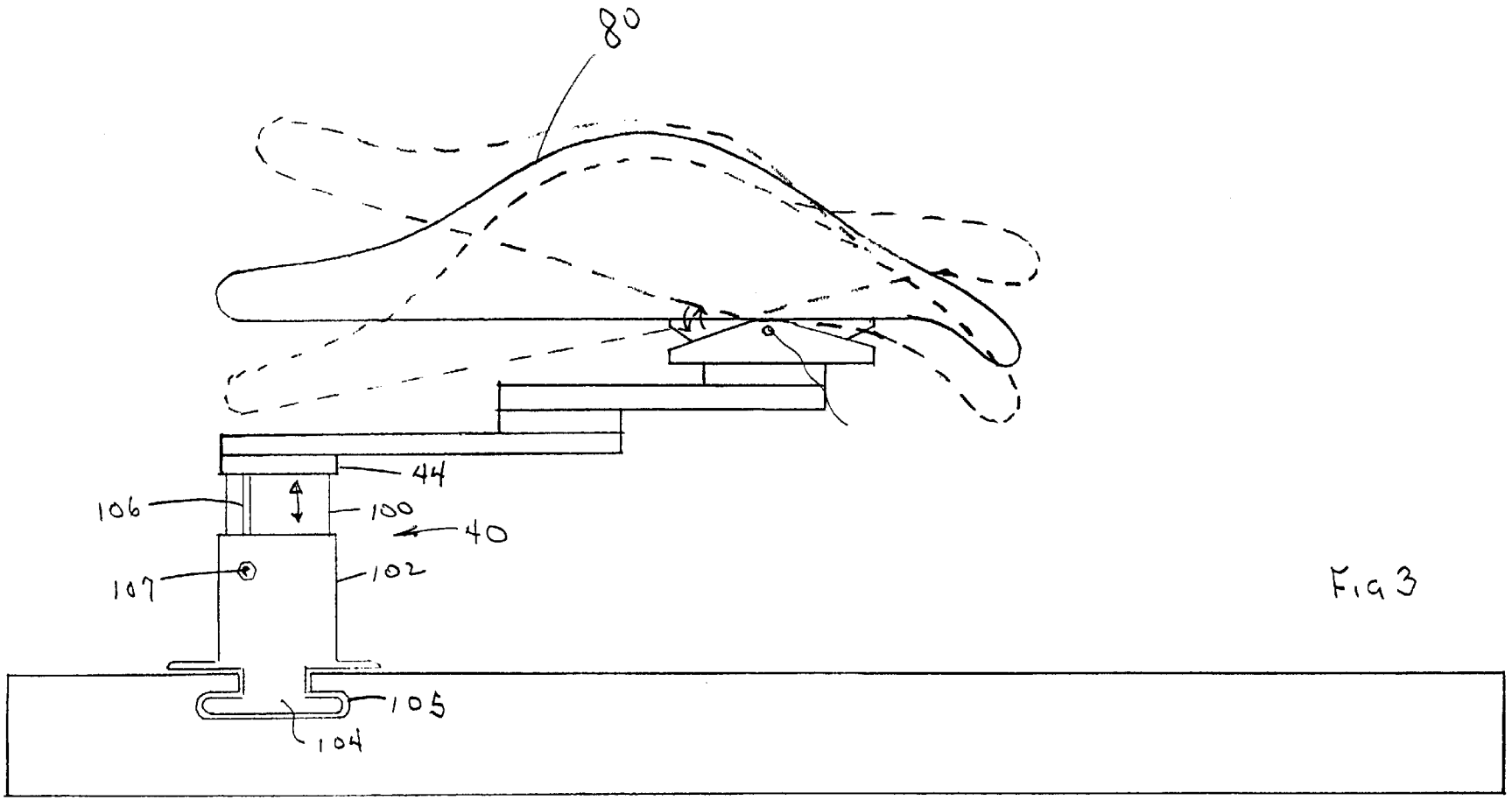
FIG. 3 is a side view of a subassembly in accordance with the invention showing a telescoping post for adjusting the height of the armrest relative to the support plate.

In accordance with a preferred embodiment of the invention, the post 40, as depicted in FIG. 3, is constructed to telescope for enabling the height of the armrest to be adjusted relative to the surface 22 of the base plate 20. More particularly, the post is comprised of an interior member 100 which can move vertically within an outer collar 102 having a depending T-shaped member 104 mounted to slide in slotted guideway 105. The interior post member 100 includes a vertically oriented groove 106 which cooperates with a locking screw 107. The locking screw 107 permits the height of the member 100 and coupling 44 to be adjusted for the user's comfort.

Figure 4:
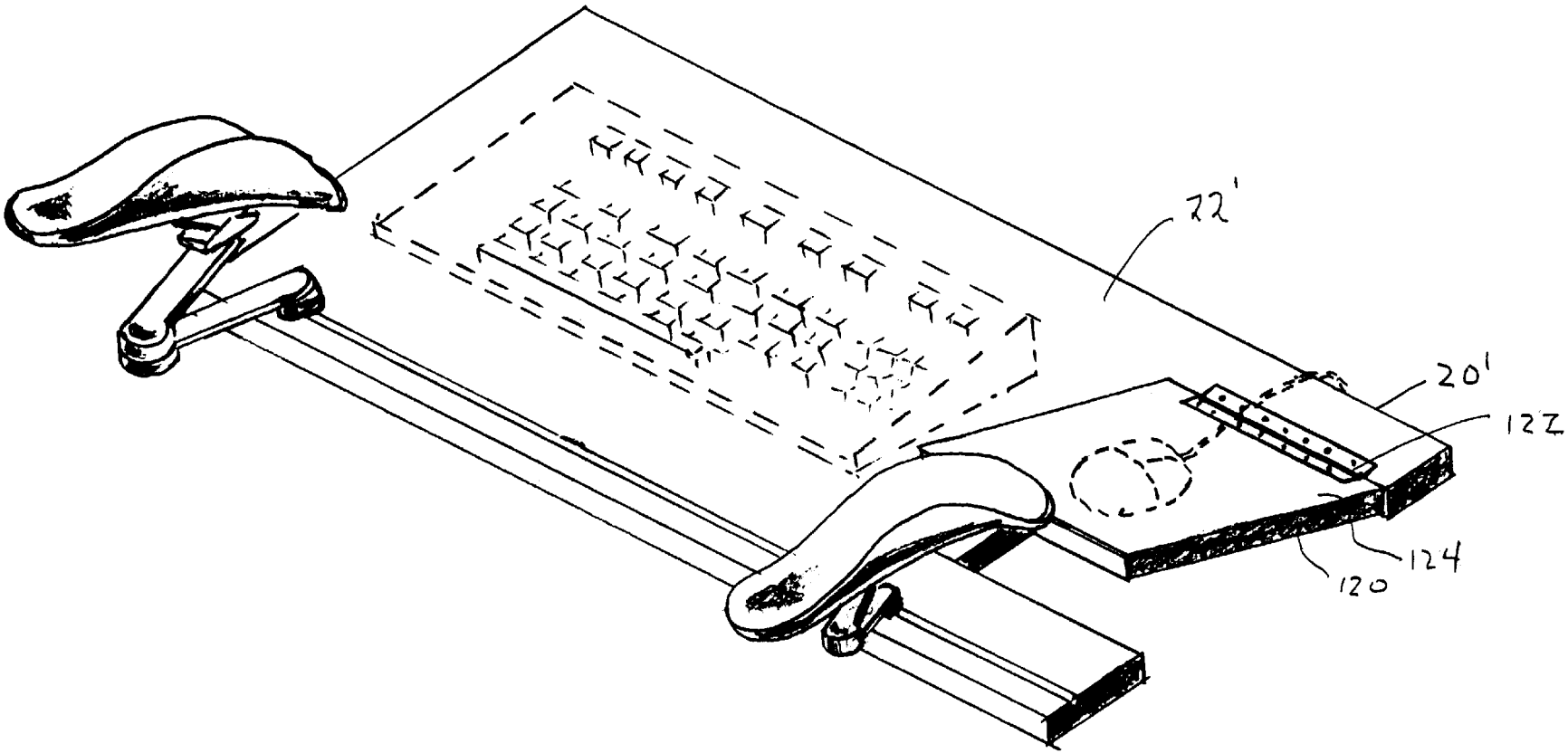
FIG. 4 is an isometric view of a preferred keyboard support plate including a hinged plate portion for supporting a mouse.
Figure 5:
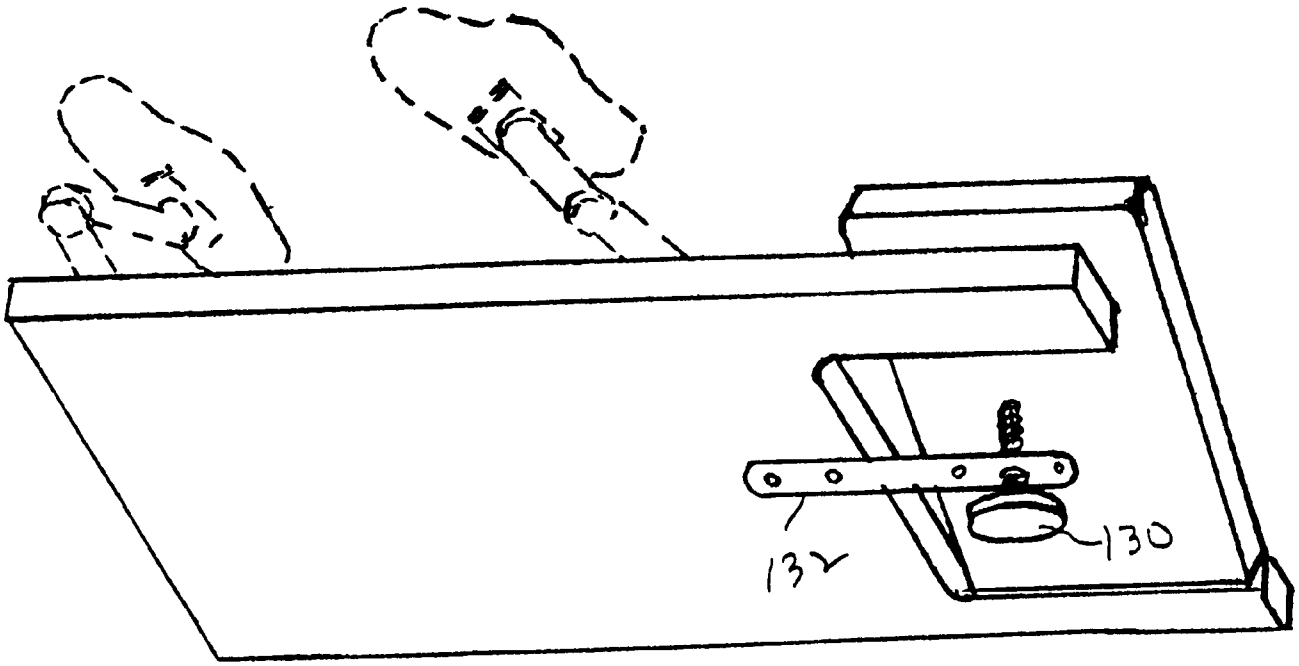
FIG. 5 is a bottom isometric view of the support plate of FIG. 4 showing how the tilt angle of the hinged plate portion can be adjusted for the convenience of the user.

As depicted in FIG. 1, support plate 20 defines a surface 22 having an area large enough to accommodate the keyboard 24 and also a pointing device such as a mouse 110. A preferred keyboard support plate 20' is illustrated in FIG. 4 which includes a hinged plate portion 120. More particularly, plate portion 120 is hinged at 122 enabling the angle of its surface 124 to be varied relative to the plate primary surface area 22'. The angle of surface 124 can be set via a tilt screw 130 and bracket 132 as depicted in FIG. 5 showing a bottom view of the plate 20'. By adjusting the screw 130, a user can fix the tilt angle of surface 124 to his liking to provide optimum control of the pointing device.

In use, a user will rest his left and right forearms in the armrests of subassemblies 26 and 28, respectively. By supporting the user's forearms and wrists, the user's body stress and fatigue will be considerably relieved. Nevertheless, the user retains essentially full lateral, longitudinal, and vertically mobility of his hands. Major lateral mobility is afforded by the mounting of the subassembly posts in laterally directed slot 34. Additional minor lateral mobility is afforded by the first and second swivel couplings 44 and 50 which also provide significant longitudinal mobility to enable the user to readily reach all of the rows of the keyboard. The tilting of the armrest enables the user to readily operate the keys without wrist flexing.

The arm support subassemblies have been illustrated in combination with a keyboard support plate. The keyboard support plate can, in fact, comprise a portable member usable with any desk or table surface. Alternatively, arm support subassemblies in accordance with the invention can be installed directly on a desktop or tabletop surface which would then comprise the keyboard support plate.

Although a specific structural embodiment has been disclosed herein, it is recognized that variations and modifications will readily occur to those skilled in the art which fall within the spirit and scope of the invention as defined by the appended claims.

What is claimed is:

1. Apparatus for use in combination with a keyboard support plate for supporting a user's forearms while allowing substantially full lateral and longitudinal movement of the user's hands relative to a keyboard horizontally supported on said support plate, said apparatus comprising:

left and right arm support subassemblies adapted to be mounted adjacent to said support plate spaced from each other by an adjustable lateral distance;

each of said arm support subassemblies including:

a post supported for lateral movement parallel to said support plate;

an armrest configured to support the user's forearm, said armrest comprising a body including a central support floor and spaced side walls extending upwardly therefrom to define an elongate recess for accommodating the user's forearm, said floor comprising an elongate support surface including a first portion extending forwardly from a rear edge of said floor to an intermediate location and a second portion extending forwardly from said intermediate location to a front edge of said floor said second portion being shorter than first portion and inclined downwardly relative to said first portion for comfortably accommodating the user's wrist; and linkage means mounted on said post for supporting said armrest above said support plate, said linkage means including at least one coupling connected to said armrest closer to said front edge than said rear edge and configured to permit said armrest to swivel around an axis oriented substantially perpendicular to said support plate and tilt around an axis oriented substantially parallel to said support plate.

2. The apparatus of claim 1 wherein said coupling permits swivel movement through a range of at least 360°.

3. The apparatus of claim 1 wherein said coupling permits tilt movement through a range limited to ±20°.

4. The apparatus of claim 1 including means for adjusting the height of said armrest above said support plate.

5. The apparatus of claim 1 wherein said coupling is attached to said armrest closer to said front edge than said rear edge.

6. The apparatus of claim 1 further including:

a support plate having an upper surface defining a recessed laterally directed slot; and wherein said posts of said left and right subassemblies are mounted for translational movement along said slot.

7. The apparatus of claim 1 further including:

a support plate having a plate portion hinged relative to the remainder of said support plate for providing a flat surface which can be adjustably tilted to optimally support a pointing device.

8. An assembly for supporting the forearms of a keyboard user while allowing substantially full mobility of the user's hands for enabling the user to operate a keyboard, said assembly comprising:

left and right subassemblies configured for mounting adjacent to a keyboard support plate, each of said subassemblies including:

a first link having a first end mounted for swivel movement around a first axis oriented substantially perpendicular to said support plate;

a second link having a first end coupled to a second end of said first link for swivel movement around a second axis oriented substantially perpendicular to said support plate;

an armrest for supporting the user's forearm, said armrest comprising a body including a central support floor and spaced side walls extending upwardly therefrom to define an elongate recess for accommodating user's forearm said floor comprising an elongate support surface including a first portion extending forwardly from a rear edge of said floor to an intermediate location and a second portion extending forwardly from said intermediate location to a front edge of said floor, said second potion being shorter than first portion and inclined downwardly relative to said portion for comfortably accommodating the user's wrist; and means supporting said armrest closer to said front edge than said rear edge on a second end of said second link for swivel movement around a third axis oriented substantially perpendicular to said support plate and tilting movement around a fourth axis oriented substantially parallel to said support plate.

9. The assembly of claim 8 wherein each of said subassemblies further includes a post defining said first axis; and wherein said first end of said first link is coupled to said post for swivel movement around said first axis.

10. The assembly of claim 9 wherein said post is configured for translational movement relative to said support plate.

11. The assembly of claim 8 wherein each of first and second links comprises a rigid elongate member defining first and second ends.

12. The assembly of claim 8 wherein said first end of said first link is mounted for swivel movement around said first axis through a range of at least 360°.

13. The assembly of claim 8 wherein a range of swivel movement around each of said first and second axis is at least 360°.

14. The assembly of claim 8 wherein said armrest is supported for tilting movement around said fourth axis through a range limited to ±20°.

15. Apparatus for use in combination with a keyboard support plate for supporting a user's forearms while allowing substantially full lateral and longitudinal movement of the user's hands relative to a keyboard horizontally supported on said support plate, said apparatus comprising:

left and right arm support subassemblies adapted to be mounted adjacent to said support plate spaced from each other by an adjustable lateral distance;

each of said arm support subassemblies including:

a post supported for lateral movement parallel to said support plate;

first and second rigid links each having first and second ends;

means coupling said first end of said first link to said post for swivel movement around a first axis oriented substantially perpendicular to said support plate, means coupling said first link second end to said second link first end for swivel movement around a second axis oriented substantially perpendicular to said support plate;

an armrest configured to support the user's forearm; and means supporting said armrest on a second end of said second link for tilting motion around an axis oriented substantially parallel to said support plate, said armrest comprising a body including a central support floor and spaced said walls extending upwardly therefrom to define an elongate recess for accommodating the user's forearm, said floor comprising an elongate support surface including a first portion extending forwardly from a rear edge of said floor to an intermediate location and a second portion extending forwardly from said intermediate location to a front edge of said floor and wherein said second portion is shorter than first portion and inclined downwardly relative to said first portion for comfortably accommodating the user's wrist.

16. The apparatus of claim 15 including a guideway affixed relative to said support plate; and wherein said post is mounted for lateral movement along said guideway.

17. The apparatus of claim 15 further including a swivel coupling between said second end of said second link and said armrest for enabling said armrest to swivel around a third axis oriented substantially perpendicular to said support plate.

* * * * *